United States Patent [19]

Baldwin

[11] 4,181,136

[45] Jan. 1, 1980

[54] PIPE FOR DRAWING SMOKE THROUGH AND EXTRACTING JUICE FROM A PIECE OF FRUIT

[76] Inventor: Alfred D. Baldwin, 409 Twin Oak Rd., Short Hills, N.J. 07078

[21] Appl. No.: 932,426

[22] Filed: Aug. 10, 1978

[51] Int. Cl.[2] ..... A24F 1/32

[52] U.S. Cl. ..... 131/171 R; 131/178

[58] Field of Search ..... 131/171, 170 R, 173, 131/178, 200, 226, 230; 222/81, 80

[56] References Cited

U.S. PATENT DOCUMENTS

| | | | |
|---|---|---|---|
| 418,511 | 12/1889 | Forster | 131/226 X |
| 1,161,759 | 11/1915 | Ayerst | 222/811 |
| 1,649,755 | 11/1927 | Thompson | 222/81 X |

FOREIGN PATENT DOCUMENTS

| | | | |
|---|---|---|---|
| 389 | of 1806 | United Kingdom | 131/230 |

*Primary Examiner*—Stephen C. Pellegrino

*Attorney, Agent, or Firm*—Charles E. Baxley

[57] ABSTRACT

A pipe for smoking tobacco and the like while sucking a piece of fruit, the device permitting the smoke to contact pulp of the fruit to escort the natural flavors from the fruit thereby enhancing taste to the smoker.

1 Claim, 5 Drawing Figures

PIPE FOR DRAWING SMOKE THROUGH AND EXTRACTING JUICE FROM A PIECE OF FRUIT

DESCRIPTION OF INVENTION

Figure 1:
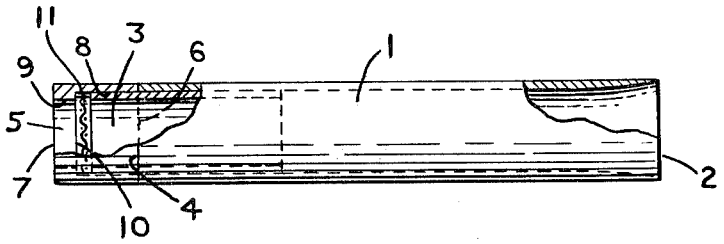
FIG. 1 is a cut away front view of the pipe assembled for storage.
Figure 2:
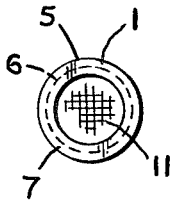
FIG. 2 is a left side view of FIG. 1.
Figure 3:
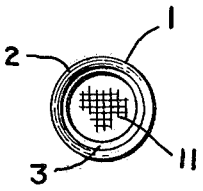
FIG. 3 is a right side view of FIG. 1.
Figure 4:
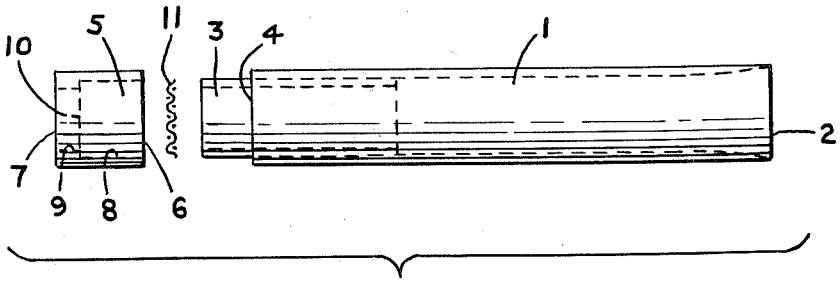
FIG. 4 is a front view of the disassembled pipe before use.

The invention comprises, as most easily viewed in FIG. 4, a first hollow tube 1 having a sharpened edge 2 and a sleeve 3 at a blunt edge 4, and a hollow second tube 5 having edges 6 and 7, the inside diameter of edge 6 being larger than that of edge 7. Corresponding inside walls 8 and 9 of tube 5 meet internally therein forming lip 10 to hold screen 11 in place when tube 5 is inserted over sleeve 3 as shown in the assembled pipe of FIG. 1. In the assembled edge 6 of pipe tube 5 is flush against the blunt edge 4 of tube 1. Any conventional means for fastening tube 5 to tube 1 may be used.

Figure 5:
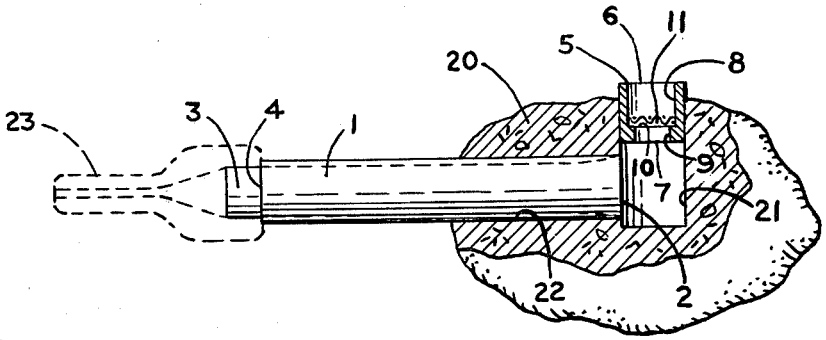
FIG. 5 is a cut away front view of the pipe as used with a piece of fruit.

Referring to FIG. 5, sharpened edge 2 of tube 1 is used to carve an L-shaped passageway in a piece of fruit 20. This is done by making a vertical insertion 21 and a horizontal insertion 22, tube 1 remaining therein, sharpened edge first. Tube 5 is then placed within the first insertion, smaller inside diameter first such that lip 10 is able to hold screen 11 on which tobacco is placed. Smoke from the ignited tobacco or the like passes through line 5 and insertion 21 wherein the smoke contacts pulp of the fruit 20 and flows with the fruit juices through tube 1 to the mouth of the user. Mouthpiece 23 may be adapted to sleeve 3.

Sleeve 3 may be integral with tube 1, or alternatively, it may consist of a separate tube when outside wall fits within tube 1 and is fastened thereto by welding, braising or other means.

It will be understood that various deviations may be made from the foregoing preferred embodiment of the invention without departing from the main theme of the invention set forth in the claim which follows. For example, the sequence of carving holes in the fruit may be varied.

I claim:

1. A device for smoking tobacco and the like while sucking a piece of fruit, the device comprising:

a hollow first tube having a sharpened edge at one end and a sleeve at the other end, the sharpened edge capable of carving a substantially L-shaped passageway within the piece of fruit by a vertical first insertion meeting with a horizontal second insertion, said tube resting within the horizontal insertion sharpened edge first;

hollow second tube having a larger inside diameter at one end and a smaller inside diameter at the other and forming internally a lip, the smaller diameter slidable over the sleeve of the first tube, said second tube resting within the vertical insertion smaller diameter first;

a screen positionable across the cross section of the second tube resting on the lip and on to which tobacco is placed whereby a suction applied to the sleeved end of the first tube causes smoke from the ignited tobacco to flow through the second tube thereby contacting the pulp and the fruit's juice which accompany the smoke leaving the fruit via the first tube, said screen matable with the lip and the sleeved edge of the first tube when the second tube is slid over the sleeve; and means for connecting the first and second tubes when the second tube is positioned on the sleeve.

* * * * *